US009187239B2

(12) United States Patent
Buck et al.

(10) Patent No.: US 9,187,239 B2
(45) Date of Patent: Nov. 17, 2015

(54) PORTABLE CONTAINMENT BERM

(71) Applicants: Larry Ray Buck, Fort Worth, TX (US); Earl G. Gauntt, Fort Worth, TX (US)

(72) Inventors: Larry Ray Buck, Fort Worth, TX (US); Earl G. Gauntt, Fort Worth, TX (US)

( * ) Notice: Subject to any disclaimer, the term of this patent is extended or adjusted under 35 U.S.C. 154(b) by 112 days.

(21) Appl. No.: 14/063,596

(22) Filed: Oct. 25, 2013

(65) Prior Publication Data

US 2015/0114956 A1 Apr. 30, 2015

(51) Int. Cl.
*B65D 90/24* (2006.01)
*B65D 90/12* (2006.01)

(52) U.S. Cl.
CPC ..... *B65D 90/24* (2013.01); *B65D 90/12* (2013.01)

(58) Field of Classification Search
CPC ..... B65D 90/24; B65D 90/12; B65D 88/526; B65D 13/00
USPC ..... 220/9.2, 571, 573
See application file for complete search history.

(56) References Cited

U.S. PATENT DOCUMENTS 5,924,461 A * 7/1999 Shaw et al. ..... 141/86
6,648,008 B1 11/2003 Price
2012/0219746 A1 8/2012 Powell
2012/0312821 A1* 12/2012 Matson ..... 220/573

OTHER PUBLICATIONS

"Secondary Containment", Secondary Containment Regulations and Best Practices Catalog, Oct. 2012, Well Pad Containment Division, New Pig Energy, URL: www.newpigenergy.com/s/Secondary-Containment-Regs-and-Best-Practices-October-2012.pdf.

* cited by examiner

*Primary Examiner* — Stephen Castellano
(74) *Attorney, Agent, or Firm* — David W. Carstens; Carstens & Cahoon, LLP

(57) ABSTRACT

An easily assembled and transportable containment system. One or more deformable foam support beams are placed end-to-end to form a containment perimeter. A first protective strip is formed on the underside of at least a portion of the length of each support beam, said protective strips extending inwardly towards the center of the containment system and providing added protection from damage that may be caused due to foot or vehicle traffic. A second protective strip rests on top of the first protective strip and adds even additional protection against damage. A containment basin comprising a floor surrounded by side walls serves to contain discharged chemicals and other potential contaminants until such time as clean-up operations may be completed. The containment basin is removably secured to the support beams via hook and loop fasteners attached to the top sides of the support beams and the top portions of the side walls.

7 Claims, 5 Drawing Sheets

PORTABLE CONTAINMENT BERM

BACKGROUND OF THE INVENTION

1. Technical Field of the Invention

The present invention relates generally to containment devices and in particular, to containment berms that are easily deployable for use in containing spills of potential hazardous waste materials or other contaminants into the ground or other undesirable locations.

2. Description of the Related Art

Numerous industries are involved in conducting operations in which the inadvertent discharge (spill) of hazardous materials and other contaminants (hereinafter collectively, "contaminants") occurs from time to time. For example, such inadvertent discharges of contaminants are known to occur in connection with both onshore and offshore oil and gas exploration and extraction operations, which involve the use of numerous chemicals, and produce other by-products that may present a contamination risk if not properly contained. The source of such discharges of contaminants that occur during oil and gas operations includes, but is not limited to, leaks emanating from storage tanks, reservoirs, well sites, pipelines and static and mobile equipment (such as motor vehicles). The contaminants that may potentially be discharged during oil and gas exploration and extraction can include substances such as fuel, unrefined oil, chemicals used in fracturing operations, flowback water and drilling mud. If left uncontained, such contaminants may be hazardous to surrounding natural resources, humans and property.

Accordingly, numerous stakeholders have an interest in preventing the discharge of such contaminants into the ground and other undesirable places that could pose a risk of harming public health, natural resources, and property. In an effort to prevent the occurrence of such discharges of contaminants into the ground, many businesses involved in onshore and offshore oil and gas exploration/extraction operations have instituted internal contamination prevention protocols. Likewise, trade associations for the oil and gas industry have established guidelines for proper procedures and methods for preventing discharges of contaminants. Federal and state governmental bodies have also promulgated regulations requiring the practice of certain contamination prevention procedures and methods. Such federal and state regulations often further require the use of specialized equipment configured to prevent inadvertent discharges of contaminants into the ground or other undesirable places.

While numerous protocols, guidelines and regulations are focused on preventing the discharge of contaminants in the first instance, other protocols, guidelines and regulations are focused primarily on containing the contaminants after such a discharge has already occurred. The use of containment systems and devices is the primary means by which contaminants are contained for the period of time until cleanup operations can take place. Examples of known containment systems include dikes, berms, retaining walls, curbing, drip pans, catchment basins, spill diversion ponds and retention ponds. One drawback of such known containment systems is that in many instances, they take an inordinate amount of time in which to construct and/or assemble, and deploy in the field.

Another drawback of many containment systems known in the art is that they are not optimally configured for interaction with vehicles. More specifically, many containment systems are easily damaged by motor vehicles when such vehicles enter and exit the perimeter of said berms, primarily as a result of the vehicle's tires damaging the structure of the berm or tearing the fabric with which the berm is constructed. An even further drawback of many known containment systems is that they are not easily transportable. Many such systems are not configured such that they can be disassembled and easily transported in modular units suitable for storage within a vehicle, aircraft, or other means of transportation (or container unit adapted for use with such mode of transportation).

Accordingly, a need exists in the art for an easily deployable and portable containment system that provides improved protection from damage caused by vehicles entering and exiting said system.

SUMMARY OF THE INVENTION

Accordingly, there is provided herein, in various embodiments, an easily deployable portable containment berm system that is transportable, may be expeditiously deployed in the field, and provides improved structures for reducing damage that may be caused by vehicles. The present invention seeks to remedy many of the problems found in the prior art discussed above, and other problems not discussed herein.

In one aspect of the invention, one or more substantially deformable foam support beams are removably attached end-to-end such that the beams form an enclosed perimeter having a shape such as, for example, a square or rectangle. The support beams are preferably constructed of closed-cell foam or other similarly deformable material, allowing the beams to have the rigidity necessary to support the walls of the containment system, but also permitting vehicle wheels to roll over them without causing damage to either the containment system or the vehicle. The foam support beams are wrapped in chemically resistant material such as polyvinyl chloride, which provides protection against damage to the support beams that may be caused by exposure to contaminants.

In another aspect of the invention, a first protective strip is formed onto the bottom side of the support beams, and extends inwardly towards the center of the perimeter of the containment system. The first protective strip aids in protecting upper layers of the containment system from damage that may be caused by obstructions emanating from the ground or other surface upon which the containment system rests. The first protective strip also helps to protect the containment system from damage that may be caused by vehicle and/or foot traffic. A second protective strip composed of a heavier polyvinyl chloride material may be placed on top of the first protective strip to add further protection from damage to the containment system.

In a further aspect of the invention, an upper layer of the containment system is comprised of a containment basin, which serves to contain any inadvertently discharged chemicals and other contaminants. The containment basin includes a floor that is intended for use in a substantially horizontal orientation. The containment basin further includes side walls formed on the outer perimeter of said floor, said side walls having a bottom portion that is intended to be deployed in a substantially vertical orientation. The side walls of the containment basin also include a top portion configured to rest on and be secured to the top side of the support beams, said support beams thereby providing a structure to support the containment basin.

In an even further aspect of the invention, a first securing material comprising hook and loop fasteners is attached to the underside of the top portion of the side walls, along the outer edge of said side walls. A second securing material comprising hook and loop fasteners formed to mate with the first material comprising hook and loop fasteners, is attached to the top side of the support beams, along an outer edge thereof. Through the use of the aforementioned hook and loop fasteners, the containment basin may be removably secured to the support beams, allowing the containment system to be easily assembled and disassembled in the field.

BRIEF DESCRIPTION OF THE SEVERAL VIEWS OF THE DRAWINGS

A more complete understanding of the invention may be had by reference to the following detailed description when taken in conjunction with the accompanying drawings, wherein.

Figure 1:
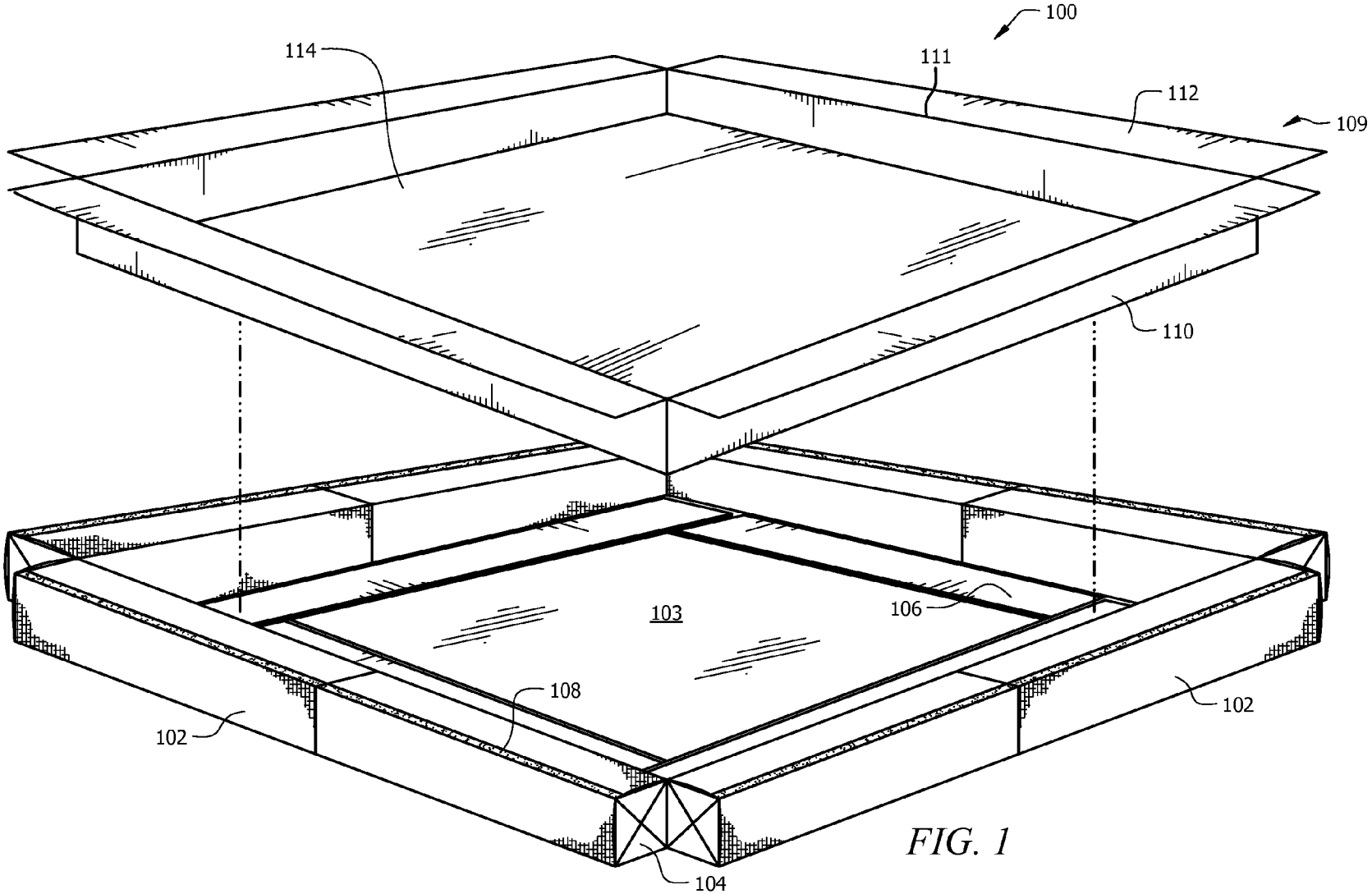
FIG. 1 shows an exploded view of an embodiment of the containment system, showing how the containment basin nests within the perimeter formed by the foam support beams.

Where used in the various figures of the drawings, the same reference numerals designate the same or similar parts. Furthermore, when the terms "front," "back," "rear," "aft," "forward," "first," "second," "upper," "lower," "height," "top," "bottom," "outer," "inner," "width," "length," "end," "side," "horizontal," "vertical," and similar terms are used herein, it should be understood that these terms have reference only to the structure shown in the drawing and are utilized only to facilitate describing the invention.

All figures are drawn for ease of explanation of the basic teachings of the present invention only; the extensions of the figures with respect to number, position, relationship, and dimensions of the parts to form the preferred embodiment will either be explained or will be within the skill of persons of ordinary skill in the art after the following teachings of the present invention have been read and understood. Further, the exact dimensions and dimensional proportions to conform to specific width, length, and similar requirements will likewise be within the skill of the art after the following teachings of the present invention have been read and understood.

Detailed Description Of The Drawings

Several embodiments of Applicant's invention will now be described with reference to the drawings. In most cases, the items being discussed below correlate to a figure and one or more reference numerals appearing on the attached drawings.

Referring to FIG. 1, an exploded view of an embodiment of the containment system, showing how the containment basin nests within the perimeter formed by the support beams is depicted therein. The containment system (100) comprises multiple layers of structures configured to prevent the discharge of contaminants and/or to prevent the containment system itself from being damaged. An outer perimeter of the containment system is formed by one or more substantially deformable support beams (102). The support beams (102) are preferably constructed at least partially of closed-cell foam, providing a semi-rigid structure to support the containment system. While closed-cell foam is the material used to construct the support beams of the embodiment shown in FIG. 1, it is contemplated the other alternate embodiments of the invention may include support beams constructed of other deformable materials such as open cell foam, rubber and other polymers. By way of example, support beams of alternate embodiments of the containment system may be constructed by joining one or more inflatable tubing segments constructed of plastic material or other some other deformable but durable material. In such alternate embodiments, the inflatable tubing segments could be inflated with air, water, or some other gas or liquid, and adjoined or attached together, to form support beams for the containment system. One advantage of utilizing such an alternate embodiment is that the inflatable support beams could be deflated when not in use and easily packed for transporting and/or storage.

A containment system may be assembled by adjoining or attaching one or more support beams (102) to one another in an end-to-end manner as shown in FIG. 1. Single segments of a support beam may be used to form a side or sides of the containment system. Alternatively, and as shown in FIG. 1, multiple support beams may be joined end-to-end to form a side of the containment system. In even further alternate embodiments of the containment system, a single support beam may be used, said support beam not being linear in shape but rather having ends that are removably or non-removably joined together to form a perimeter of the containment system.

The desired size of the containment system will be considered by those of ordinary skill in the art when choosing how to configure the placement of support beams. Support beams preferably have substantially square cross-sections having sides of approximately six inches. However, it is contemplated that other alternate embodiments of the containment system may have support beams of various shapes and sizes. For example, an alternate embodiment of the container system may include support beams having a cross-section in a substantially trapezoidal, triangular, or semi-circular shape such that the base of the support beam is wider than the top portion of the support beam. The use of such alternate embodiments having a trapezoidal, triangular or semi-circular shaped support beam may provide advantages in that vehicles may more easily traverse the support beam as they enter and exit the containment system.

The support beams are preferably wrapped in a chemically resistant fabric which serves to protect the support beams from damage that may be caused by exposure to contaminants and also from damage caused by motor vehicle wheels. Polyvinyl chloride (PVC) is preferably used to serve as the chemically resistant fabric in which to wrap the support beams as it provides optimal chemical and mechanical properties. While PVC is used to wrap the support beams of the preferred embodiment of the containment system, other chemically resistant and durable materials may be used. Preferably, any material used to protect the support beams will have a coefficient of permeability of no greater than $1\times10^{-10}$ cm./sec. and be chemically compatible with any chemicals likely to come into contact with such material. While such a coefficient of permeability is preferable, it is by no means essential and alternate embodiments of the fabric may have differing greater such coefficients of permeability. Such material should also be durable and able to support the weight of vehicles that may traverse its surface. The material used to protect the support beams may be secured to the support beams by stitching, stapling, seam welding, or any other manner of fastening/attaching.

Attached to the bottom of the support beams is a first protective strip (103) that extends inwardly across the containment system. The first protective strip (103) is preferably composed of a PVC material but may alternatively be any other durable material that can withstand the forces that it may be subjected to when vehicles and personnel enter and exit the containment system perimeter. The first protective strip (103) is preferably of length that allows it to span the distance across the containment system perimeter. However, those of ordinary skill in the art will appreciate that the length of the first protective strip may be configured to be of various lengths, taking into consideration factors such as the overall dimensions of the containment system, the types of vehicles likely to be used in conjunction with the containment system, and the type of ground on which the containment system rests. Furthermore, while the first protective strip (103) of the containment system discussed in connection with the embodiment shown in FIG. 1 is connected to multiple support beams, other alternate embodiments of the containment system may utilize first protective strips that are attached to only a single support beam.

One function of the first protective strip (103) is to provide protection from damage that may be caused by protrusions emanating from the ground or other surface underneath the containment system. As vehicles entering and exiting the containment system perimeter also typically stress the walls of said containment system, the first protective strip serves to add increased protection from damage that may be caused by such vehicles. According, to the extent that the first protective strip is not utilized to span across the entire perimeter of the containment system, the length of the first protective strip may be selected by those of ordinary skill in the art by taking into consideration where the wheels of any vehicles entering and exiting the containment system, may contact said first protective strip.

A second protective strip (106) is configured to rest on top of the first protective strip (not shown in FIG. 1). The material used to construct the second protective strip is preferably PVC, although like the first protective strip, alternate embodiments may utilize other durable materials for the second protective strip. The second protective strip (106) is preferably heavier than the first protective strip in that it has an increased rated weight as compared to the first protective strip, as the second protective strip is intended to provide increased protection from protrusions emanating from the ground, as well as protecting additional upper layers of the containment system as discussed further below. Although the second protective strip of the embodiment of the container system shown in FIG. 1 is not attached to any other structures of the containment system, the second protective strip of other alternate embodiments of the containment system may be attached (either removably or non-removably) to any other structures comprising the containment system.

Providing a first upper layer of containing discharged contaminants is a containment basin (109) that is configured to be nested within the perimeter formed by the support beams (102). The containment basin is comprised of a floor (114) and side walls (109). The floor (114) of the containment basin is intended to be deployed in a substantially horizontal orientation and namely, the same orientation of the ground or other surface upon which the containment system is intended to rest. While the floor (114) of the containment basin (109) as shown in FIG. 1 is a unitary panel, other alternate embodiments of the containment system may include a basin floor constructed of multiple panels attached together. Such multiple panels in alternate embodiments of the containment system may be attached to one another via any known manner for joining such materials such as, for example, seam welding through use of a wedge welder, chemical fusion, and through the use of chemical adhesives. The size and number of such panels comprising a basin floor in alternate embodiments of the containment system may be selected by those of ordinary skill in the art after considering the desired dimensions of the overall containment system.

The containment basin (109) further comprises side walls (110, 112) formed along the outer perimeter of the basin floor (114). The side walls serve to both contain the movement of contaminants discharged into the basin, as well as to provide a structure to secure to the support beams. The containment basin (109) is constructed of a chemically resistant fabric such as a polymeric geomembrane. The containment basin is preferably constructed of PVC, at a weighted rate of at least twenty-two ounces per square yard. While PVC serves as the material utilized to form the basin of the preferred embodiment of the containment system, other chemically resistant and durable materials may be used as will be recognized by those of skill in the art. Preferably, any material used to serve as the containment basin will have a coefficient of permeability of no greater than $1\times10^{-10}$ cm./sec. and be chemically compatible with any chemicals likely to come into contact with such material. While such a coefficient of permeability is preferable, it is by no means essential and alternate embodiments of the fabric used to construct the basin may have differing greater such coefficients of permeability.

The material used to serve as the containment basin (109) should also be durable enough to withstand the stresses that it may be subjected to as a result of vehicle and foot traffic into and out of the containment system. Mechanical properties such as tensile strength, tear resistance, impact resistance, puncture resistance, interface shear strength, anchorage strength, and stress cracking should be considered by those of skill in the art when selecting a material to use as the containment basin. Factors to be considered when ensuring that a particular material's mechanical properties are suitable for use as a basin include whether vehicles are to be used in conjunction with the containment system (if so, the weight of such vehicles), as well as the types and volumes of contaminants that could potentially be discharged into the containment system. Materials other than PVC that may alternatively be used to construct the containment basin, if used at an appropriate weighted rate, include high-density polyethylene (HDPE), linear low-density polyethylene (LLDPE), flexible polypropylene (fPP), chlorosulphonated polyethylene (CSPE), and ethylene propylene diene terpolymer (EPDM).

The side walls of the basin include a substantially vertical bottom portion (110) and top portion (112). An edge (111) is formed between the bottom portion and top portion of the side walls of the container basin. The top portion of the side walls is configured to flex (or rotate) about and along the edge (111) formed between the bottom portion and top portion of said side walls. When deployed in the field, the top portion (112)

of the side wall is configured to rest on a top side of the support beams (102) and be removably secured thereto.

A first securing material (113) (not shown in FIG. 1) having hook and loop type fasteners attached thereto is attached underneath the top portion of the side wall, along the outer edge of said top portion. A second securing material (108) having hook and loop fasteners (formed to mate with hook and loop of the type found on said first securing material) is attached to the top side of the support beams along at least a portion of the length of said support beams. The second securing material (108) is preferably attached to an outer edge of the top sides of the support beams (102).

By removably securing the top portion of the side walls to the top side of the support beams along an outer edge thereof, the side walls are sufficiently supported by the support beam, thus reducing the likelihood that the containment system will be compromised should vehicle movement over the containment system induce stress on the basin (causing failure of the basin) that would otherwise result in leakage of contaminants. Further, by removably securing the basin to the support beams in the manner described herein, it is less likely the stresses to the basin (caused by vehicle movement or otherwise) at certain points, will cause the basin material to tear. Namely, because prior to tearing, the hook and loop fasteners will disengage (disattach), thereby reducing the stress that would otherwise potentially lead to a tear in the fabric. This is one advantage found in the invention that is not found in other prior art containment systems.

It should further be noted that while hook and loop fasteners are preferably used to provide the manner in which the containment basin may be removably secured to the support beams, other types of fasteners or attachments that would provide for removably securing the structures, may also be utilized in alternate embodiments. Just by way of example, magnetized material disposed along either or both of the top side of the support beams or underneath the top portion of the side walls, could be used to removably secure the structures together.

Figure 2:
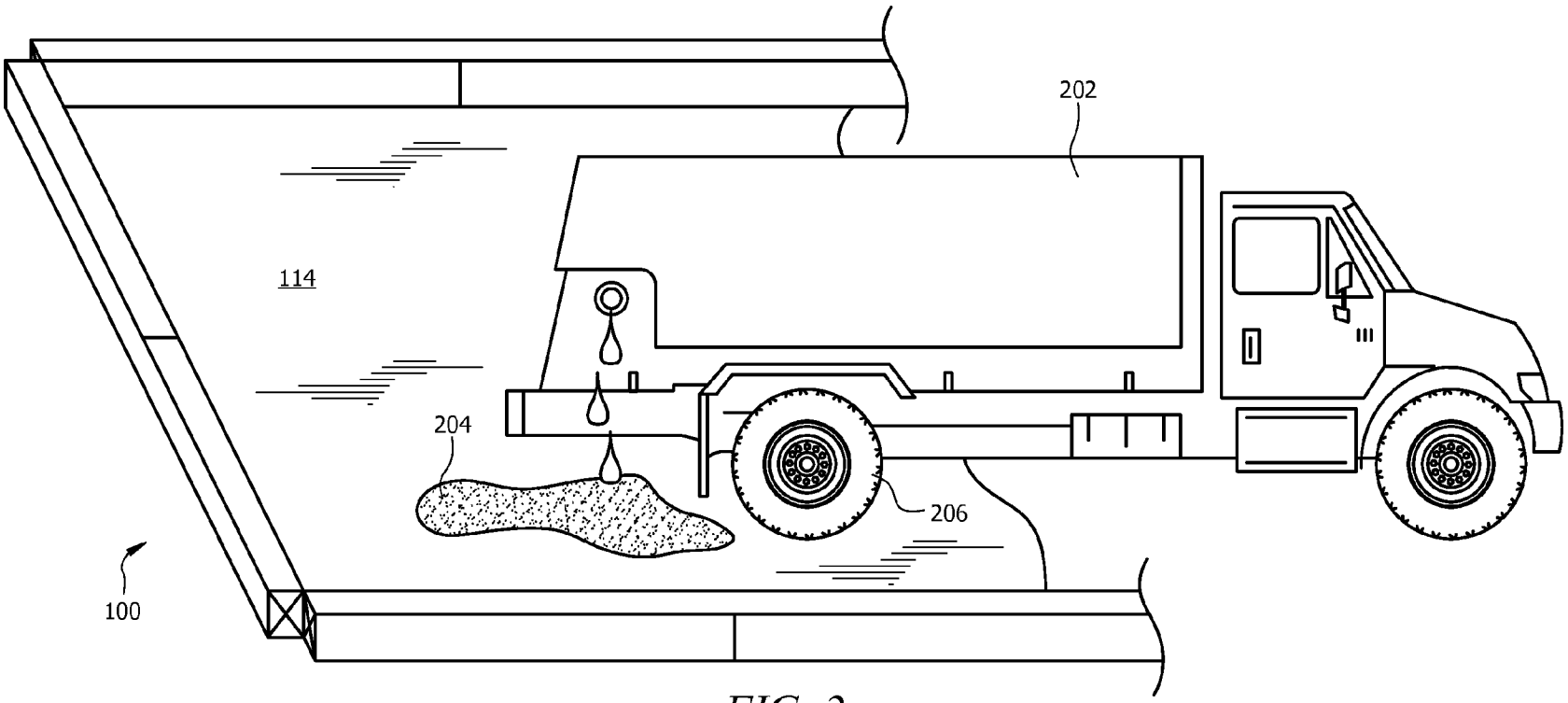
FIG. 2 shows a perspective view of the embodiment of the containment system shown at FIG. 1, demonstrating how said system serves to contain contaminants that are discharged out of a motor vehicle.

Referring now to FIG. 2, a perspective view of the embodiment of the containment system (100) shown at FIG. 1, showing how said system serves to contain contaminants that are discharged out of a motor vehicle. It should be noted that the motor vehicle shown in FIG. 2 does not form any part of the inventions described herein, but is included merely to demonstrate the practical functionality of said inventions. In particular, the containment system may be used to contain discharged contaminants (204) from both stationary and mobile sources. By way of example, the containment system may be deployed to contain contaminants that are discharged from motor vehicles such as fuel trucks (202). Such motor vehicles are commonly present at drilling sites and are a source of inadvertent discharges of contaminants.

The container system (100) is intended to be used in conjunction with motor vehicles that are required to enter and exit said containment system. For this reason, closed-cell foam is preferably used to construct the support beams, as it is configured to deform upon the impact of the wheels (206) of motor vehicles, yet expand into a semi-rigid structure after the vehicle wheel has passed. The deformable nature of the support beams serves to prevent damage to the motor vehicles as they pass over said support beams. The use of foam support beams also decreases the weight of the containment system, making the system more easily transportable, and also more easily assembled by one or more persons (or machines) in the field.

While the embodiment of the container system (100) shown in FIG. 2 is depicted as being utilized to contain discharges from a motor vehicle, it is contemplated that the containment system may be utilized to contain discharges from any number of other stationary or mobile contaminant sources. Non-limiting examples of such contaminant sources with which the containment system may be used include storage tanks, well pads, generators, frac tank containment structures, brine tanks, sewer treaters, hoses, pipelines, and fuel tanks.

Figure 3:
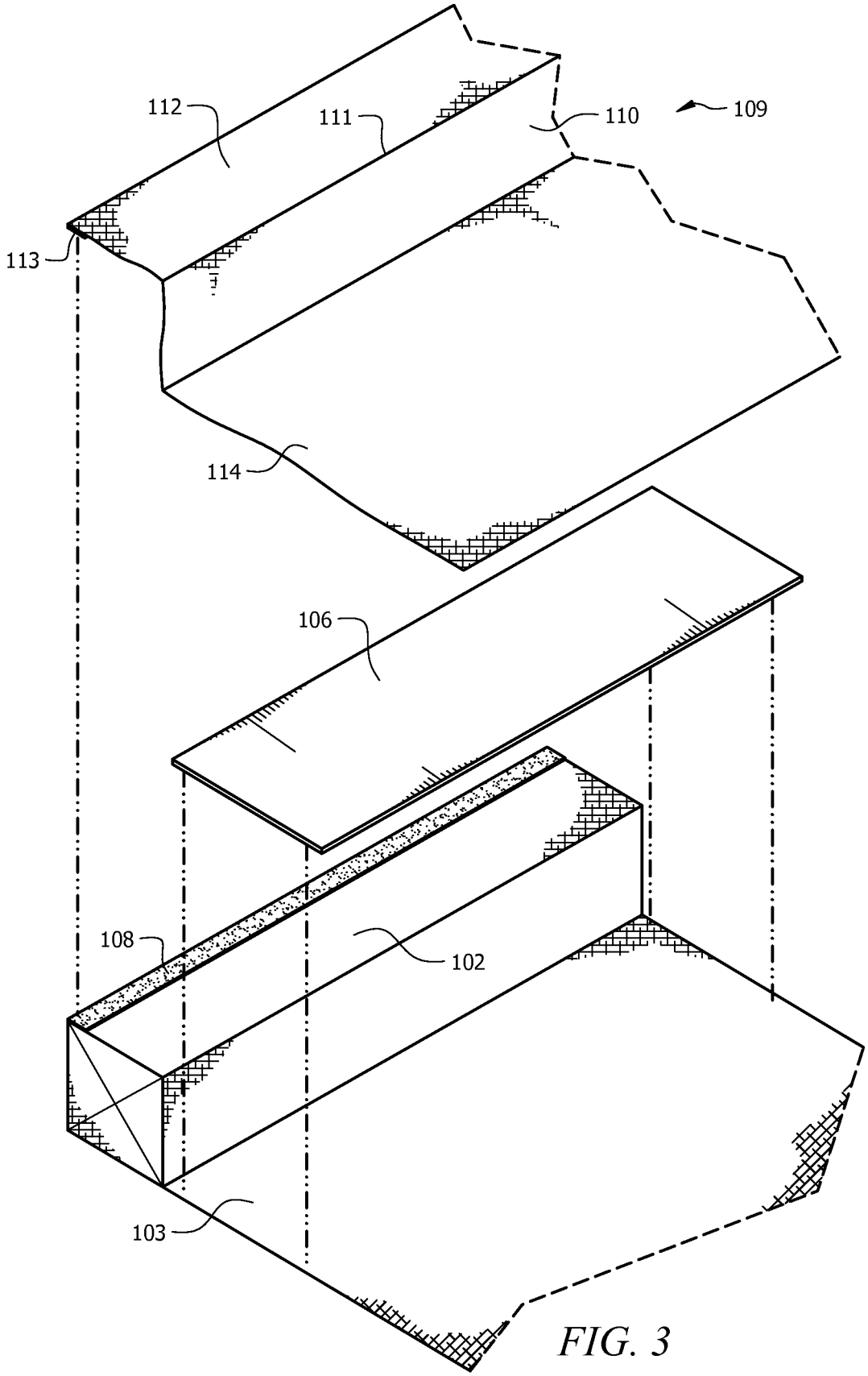
FIG. 3 shows an exploded view of a portion of an embodiment of the containment system, illustrating how the structures of said containment system are configured for placement when deployed in the field.

Referring now to FIG. 3, an exploded view of a portion of an embodiment of the containment system (100), illustrating how the structures of said containment system are configured for placement when deployed in the field. The containment system of the embodiment shown in FIG. 3 is comprised of three primary structures. The base layer resting on the ground (or other surface) is the foam support beam (102), to which the first protective strip (103) is attached on a bottom side thereof. The second securing material (108) (with a first type of hook and loop fastener) is attached to the top side of the support beam (102), preferably along an outer edge thereof. The second protective strip (106) is configured to rest on top of a portion of the first protective strip (103) that is adjacent to the support beam to which it is attached, providing added protection to the containment basin (109) and to the first protective strip (103).

As discussed above, the lengths of the first protective strip (103) and second protective strip (106) may vary depending upon factors such as the application to which the containment system is used, the vehicles to be used in conjunction with the containment system, the type of surface on which the containment system will rest, and the desired dimensions of the overall containment system. While the embodiment of the containment system described herein has a first protective strip having a length that is substantially equivalent to the distance across the containment system (distance between opposite support beams), in alternate embodiments of the containment system, the first protective strip may have a length that is substantially equivalent to the second protective strip. Likewise, it is not essential that a second protective strip be utilized at all, especially if the first protective strip is of adequate thickness and length to provide sufficient protection from damage to the containment system.

The containment basin (109) comprises a floor (114), a top portion (112) of the side wall and a bottom portion (110) of the side wall. An edge (111) runs between the bottom portion (110) of the side wall and the top portion (112) of the side wall. When deployed (nested within the support beams), the bottom portion (110) of the side wall has a substantially vertical orientation, which aids in containing any discharged contaminants. In contrast, the top portion (112) of the side wall has a substantially horizontal orientation when deployed within the containment system. The top portion (112) of the side wall is configured to rest on top of the support beams (102), removably securing thereto via hook and loop fasteners as previously discussed.

Figure 4:
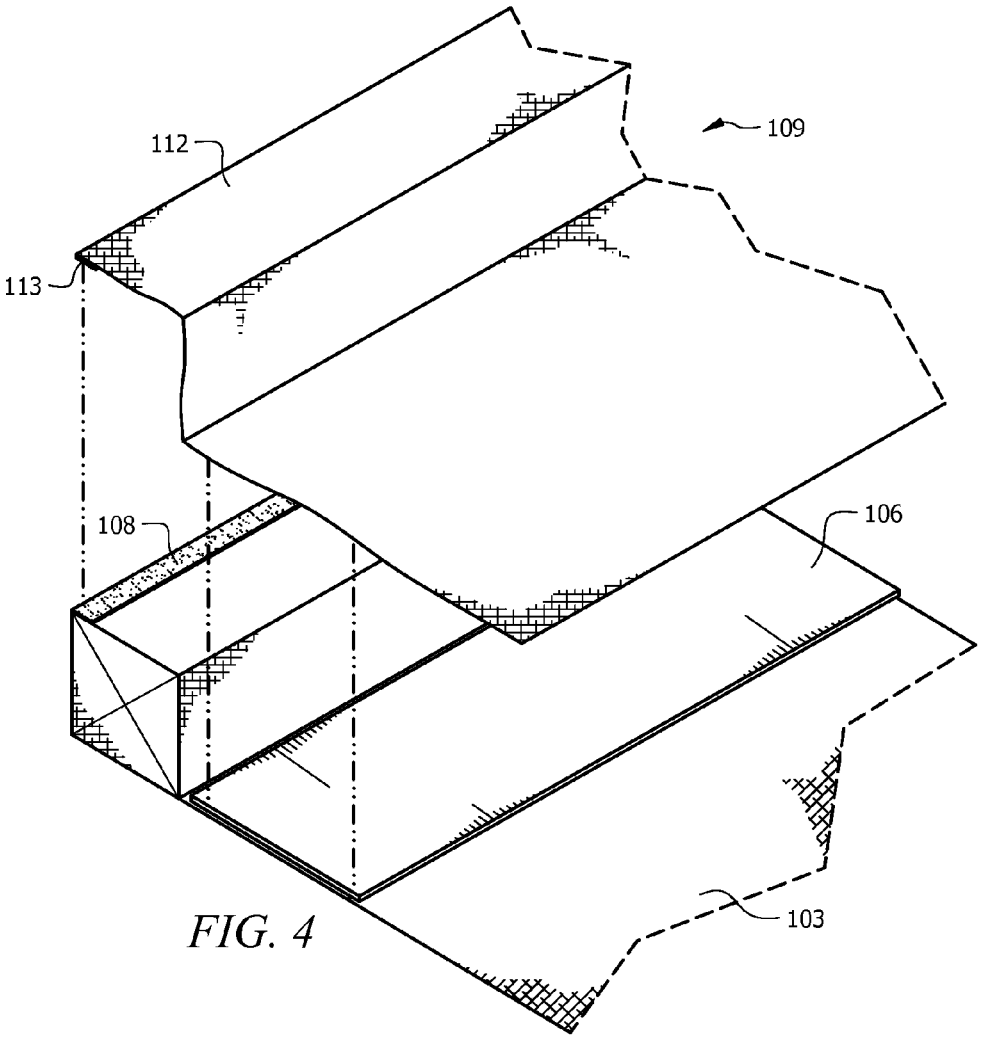
FIG. 4 shows an exploded view of a portion of an embodiment of the containment system as shown in FIG. 3, illustrating how the second protective strip is configured to rest upon the first protective strip.

Referring now to FIG. 4, an exploded view of a portion of an embodiment of the containment system as shown in FIG. 3, illustrating how the second protective strip (106) is configured to rest on the portion of the first protective strip (103) that is adjacent to the support beam to which it is attached. While the embodiment of the containment system described herein has a first protective strip having a length that is substantially equivalent to the distance across the containment system (distance between opposite support beams), in alternate embodiments of the containment system, the first protective strip may have a length that is substantially equivalent to the second protective strip. For example, it may be more likely that vehicles will be traversing a particular area of the containment system. In such a case, the first protective strip (103) and/or the second protective strip (106) may be sized to provide added protection in such areas likely to have more vehicular travel. Likewise, the thickness of the first and/or second protective strips may be sized to provide additional protection at targeted points around the containment system.

It should also be noted that while the first protective strip shown in the embodiment of the containment system discussed herein is non-removably attached to the support beam, in other alternate embodiments, said first protective strip may be removably attached to the bottom of the support beam. In even other further alternate embodiments, and in view of the contemplated need to adjust the length of the first protective strip, said first protective strip may be attached to the support beam by use of a retraction mechanism. For example, a mechanically or electrically powered extension and/or retraction mechanism may be mounted to the support beam to allow a desired length of first protective strip to be deployed (depending on the needs of the user) and then later retracted when not in use.

Still referring to FIG. 4, the first securing material (113) having hook and loop fasteners is shown attached to the bottom (underside) of the top portion (112) of the basin side wall. A second securing material (108) having a type of hook and loop fastener is shown attached to the top side of the foam support beam (102). The hook and loop fastener used on the first securing material (113) is configured to be of a first type that will engage and attach to the second type of hook and loop fastener used on the second securing material (108). It is not essential that either the first or second securing material run along the entire length of the support beams. The amount of securing material to use in connection with any application of the containment system will be selected by users after considering such factors as the dimensions of the containment system, the types of vehicles (if any) likely to be used in conjunction with the containment system, and the types and amounts of contaminants likely be discharged into the containment basin.

Figure 5:
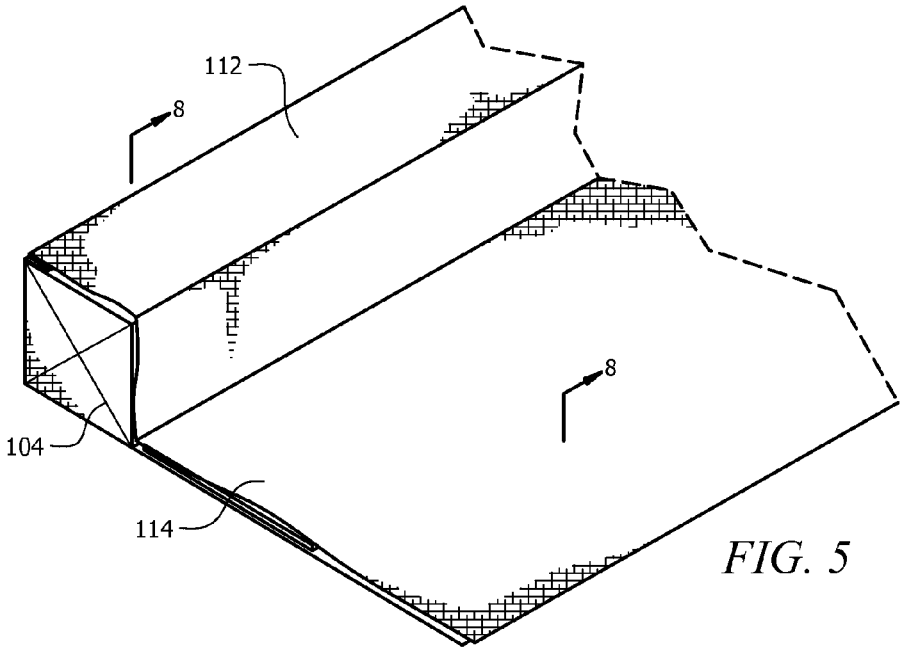
FIG. 5 shows an exploded view of a portion of an embodiment of the containment system as shown in FIG. 3, illustrating how the floor of the containment basin is configured to rest on top of the second protective strip and the top portion of the side wall is configured to rest on a top side of the support beam, removably secured thereto via hook and loop fasteners.

Referring now to FIG. 5, an exploded view of a portion of an embodiment of the containment system as shown in FIG. 3, illustrating how the floor (114) of the containment basin (109) is configured to rest on top of the second protective strip (not visible). The top portion (112) of the side wall is configured to rest on a top side of the support beam (102), removably secured thereto via hook and loop fasteners found on the first securing material and second securing material disposed along at least portion of the length of the support beams.

Figure 6:
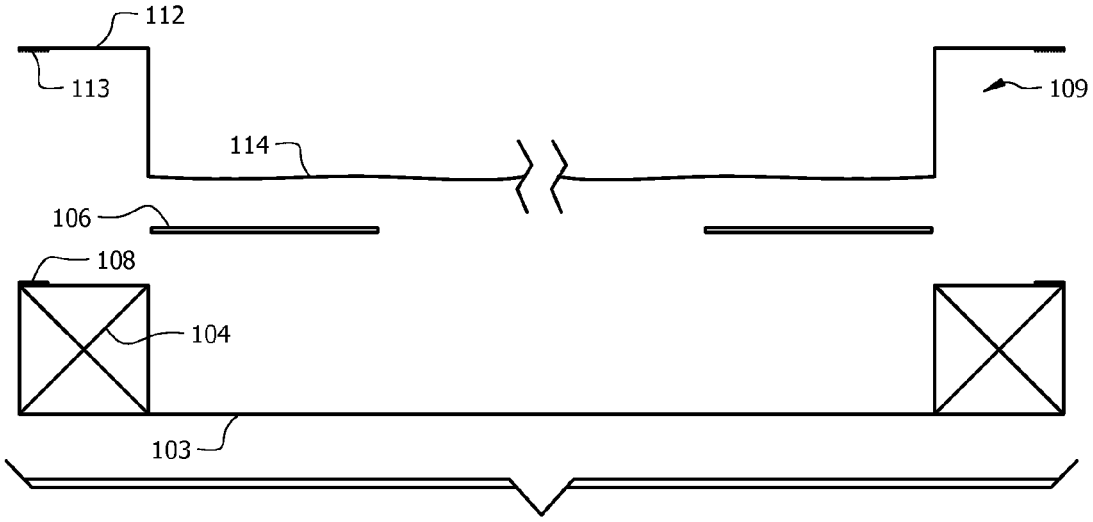
FIG. 6 shows an exploded side view of an embodiment of the containment system as shown in FIG. 1, illustrating how the layers of said containment system are configured for placement when deployed in the field.

Referring now to FIG. 6, an exploded side view of an embodiment of the containment system as shown in FIG. 1, illustrating how the layers of said containment system are configured for placement when deployed in the field. The containment system of the embodiment shown in FIG. 6 is comprised of three primary structures. The base layer resting on the ground (or other surface) is the foam support beam (104), to which the first protective strip (103) is attached on a bottom side thereof. The second securing material (108) (with a first type of hook and loop fastener) is attached to the top side of the support beam (104), preferably along an outer edge thereof. The second protective strip (106) is configured to rest on top of the portion of the first protective strip (103) that is adjacent to the support beam, providing added protection to the containment basin (109) and to the first protective strip. The containment basin (109) comprises a floor (114), a top portion (112) of the side wall and a bottom portion (110) of the side wall.

Figure 7:
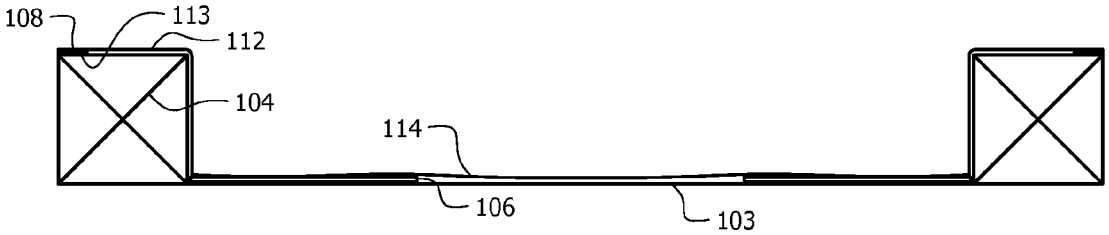
FIG. 7 shows a side view of an embodiment of the containment system as shown in FIG. 1, illustrating how the layers of said containment system rest on top of one another when deployed in the field.

Referring now to FIG. 7, a side view of an embodiment of the containment system as shown in FIG. 1, illustrating how the layers of said containment system rest on top of one another when deployed. The floor (114) of the containment basin is configured to rest on top of the second protective strip (106). The top portion (112) of the side wall is configured to rest on a top side of the support beam (104), removably secured thereto via hook and loop fasteners found on the first securing material (113) and second securing material (108) disposed along at least portion of the length of the support beams (104).

Figure 8:
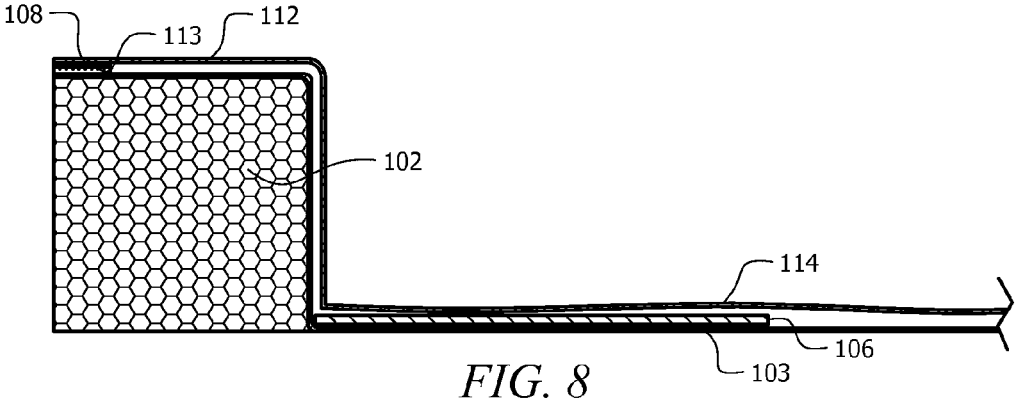
FIG. 8 shows a cross-sectional view of an embodiment of the containment system as shown in FIG. 5, illustrating how the layers of said containment system rest on top of one another when deployed in the field.

Referring now to FIG. 8, a cross-sectional view of an embodiment of the containment system as shown in FIG. 5, illustrating how the layers of said containment system rest on top of one another when deployed in the field. The floor (114) of the containment basin is configured to rest on top of the second protective strip (106). The top portion (112) of the side wall is configured to rest on a top side of the support beam (104), removably secured thereto via hook and loop fasteners found on the first securing material (113) and second securing material (108) disposed along at least portion of the length of the support beams (104).

It should be noted that the description of the present invention has been presented for purposes of illustration and description, and is not intended to be exhaustive or limited to the invention in the form disclosed. Many modifications and variations will be apparent to those of ordinary skill in the art. The preferred embodiment appearing in the drawings was chosen and described in order to best explain the principles of the invention, the practical application, and to enable others of ordinary skill in the art to understand the invention for various embodiments with various modifications as are suited to the particular use contemplated. It will be understood by one of ordinary skill in the art that numerous variations will be possible to the disclosed embodiments without going outside the scope of the invention as disclosed in the claims.

We claim:

1. A containment system comprising:

a basin having a floor and side walls, each of said side walls having a bottom portion formed along an outer edge of said floor, said sides walls being substantially perpendicular to said floor, said side walls also having a top portion capable of flexing about an edge formed between said bottom portion and said top portion;

one or more substantially deformable support beams, each of said one or more support beams having a first protective strip secured to a bottom of each of said support beams and extending inwardly towards said containment basin;

a second protective strip resting on a top side of one or more of said first protective strips;

wherein said one or more of said top portion of said side walls is removably secured to a top side of said one or more support beams such that said support beams support said side walls;

wherein said top portion of said side wall is removably secured to said top side of said one or more support beams via hook and loop fasteners attached to said top portion of said side wall and said top side of said support beams; and wherein a first securing material is attached to at least a portion of an outer edge of said top side of said support beam, and a second securing material is attached to at least a portion of said bottom side of said top portion of said one or more side walls.

2. The containment system of claim 1 wherein said support beams are composed at least partially of foam material that is wrapped in chemically resistant fabric.

3. The containment system of claim 1 wherein said floor of said basin is comprised of a plurality of panels attached to one another.

4. The containment system of claim 1 wherein said first securing material has a first type of hook and loop fastener disposed thereon said first securing material, and said second securing material has a second type of hook and loop fastener disposed thereon said second securing material, wherein said first type of hook and loop fastener is configured to removably mate with said second type of hook and loop fastener.

5. The containment system of claim 1 wherein said first securing material comprises a first type of magnetized material, and said second securing material comprises a second type of magnetized material, wherein said first type of magnetized material is configured to he removably secured to said second type of magnetized material.

6. The containment system of claim 1 wherein said basin is composed substantially of polyvinyl chloride material having a rated weight of at least 22 oz./yd.$^2$.

7. The containment system of claim 1 wherein said support beams have a substantially square cross-section having sides at least four inches in length.

* * * * *